US011380266B2

(12) United States Patent
Cho et al.

(10) Patent No.: US 11,380,266 B2
(45) Date of Patent: Jul. 5, 2022

(54) DISPLAY DEVICE

(71) Applicant: Samsung Display Co., Ltd., Yongin-si (KR)

(72) Inventors: Daeyoun Cho, Yongin-si (KR); Jiho Moon, Hwaseong-si (KR); Jongwoo Park, Seongnam-si (KR); Youngtae Choi, Asan-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 17/138,762

(22) Filed: Dec. 30, 2020

(65) Prior Publication Data

US 2021/0210020 A1 Jul. 8, 2021

(30) Foreign Application Priority Data

Jan. 3, 2020 (KR) ..... 10-2020-0000634

(51) Int. Cl.
*G09G 3/3266* (2016.01)
*G09G 3/3233* (2016.01)

(52) U.S. Cl.
CPC ..... *G09G 3/3266* (2013.01); *G09G 3/3233* (2013.01); *G09G 2300/0809* (2013.01); *G09G 2310/0202* (2013.01); *G09G 2320/041* (2013.01); *G09G 2320/066* (2013.01)

(58) Field of Classification Search
None
See application file for complete search history.

(56) References Cited

U.S. PATENT DOCUMENTS

| | | | | |
|---|---|---|---|---|
| 7,015,884 | B2 | 3/2006 | Kwon | |
| 9,552,796 | B2 | 1/2017 | Lee et al. | |
| 9,711,585 | B2 | 7/2017 | Kim et al. | |
| 10,546,902 | B2 | 1/2020 | Lee et al. | |
| 2015/0364083 | A1* | 12/2015 | Jeon | G09G 3/3233 345/76 |
| 2017/0287996 | A1* | 10/2017 | Kim | H01L 27/3248 |
| 2017/0331061 | A1* | 11/2017 | Lee | H01L 27/3276 |

FOREIGN PATENT DOCUMENTS

| | | |
|---|---|---|
| KR | 10-0370286 | 1/2003 |
| KR | 10-2016-0028624 | 3/2016 |
| KR | 10-2016-0108669 | 9/2016 |
| KR | 10-2018-0051692 | 5/2018 |
| KR | 10-2018-0078861 | 7/2018 |
| KR | 10-2019-0082355 | 7/2019 |

* cited by examiner

*Primary Examiner* — Matthew Yeung
(74) *Attorney, Agent, or Firm* — H.C. Park & Associates, PLC

(57) ABSTRACT

A display device includes a light emitting diode including a first electrode and a second electrode, a first transistor connected between the first voltage line and the first electrode of the light emitting diode, a sixth transistor connected between the drain electrode of the first transistor and the first electrode of the light emitting diode, and a seventh transistor connected between the second voltage line and the first electrode of the light emitting diode and including a gate electrode for receiving an initialization scan signal, wherein an active period of the scan signal and an active period of the initialization scan signal are non-overlapping with each other and the active period of the initialization scan signal is longer than the active period of the scan signal.

17 Claims, 8 Drawing Sheets

DISPLAY DEVICE

CROSS-REFERENCE TO RELATED APPLICATION

This application claims priority from and the benefit of Korean Patent Application No. 10-2020-0000634, filed Jan. 3, 2020, which is hereby incorporated by reference for all purposes as if fully set forth herein.

BACKGROUND

Field

Exemplary embodiments of the invention relate generally to a display device and, more specifically, to a display device including an organic light emitting element.

Discussion of the Background

A display device includes a plurality of pixels. Each of the plurality of pixels includes an organic light emitting diode and a pixel circuit for controlling the organic light emitting diode. The pixel circuit includes at least one switching transistor and a storage capacitor.

The organic light emitting diode includes a first electrode, a second electrode, and an organic light emitting layer disposed between the first electrode and the second electrode. The at least one switching transistor provides a voltage corresponding to a data signal to any one of the first electrode and the second electrode of the organic light emitting diode. The organic light emitting diode emits light when a voltage equal to or higher than a threshold voltage of the organic light emitting layer is applied between the first electrode and the second electrode.

The at least one switching transistor may have an increased leakage current according to the ambient temperature. When the amount of leakage current flowing through the at least one switching transistor increases, the voltage level of the voltage provided to the organic light emitting diode may be distorted.

The above information disclosed in this Background section is only for understanding the background of the inventive concepts, and, therefore, may contain information that does not form prior.

SUMMARY

One or more exemplary embodiments of the present disclosure provide a display device capable of increasing display quality.

Additional features of the inventive concepts will be set forth in the description which follows, and in part will be apparent from the description, or may be learned by practice of the inventive concepts.

According to one or more exemplary embodiments of the invention, a display device includes a light emitting diode including a first electrode and a second electrode, a capacitor connected between a first voltage line for receiving a first power voltage and a reference node, a first transistor including a source electrode and a drain electrode, a second transistor connected between a data line and the source electrode of the first transistor and including a gate electrode for receiving a scan signal, a third transistor connected between the reference node and the drain electrode of the first transistor, a fourth transistor connected between the reference node and a second voltage line for receiving an initialization voltage, a fifth transistor connected between the first voltage line and the source electrode of the first transistor, a sixth transistor connected between the drain electrode of the first transistor and the first electrode of the light emitting diode, and a seventh transistor connected between the second voltage line and the first electrode of the light emitting diode and including a gate electrode for receiving the initialization scan signal, wherein an active period of the scan signal and an active period of the initialization scan signal are non-overlapping with each other and the active period of the initialization scan signal is longer than the active period of the scan signal.

According to one or more exemplary embodiments, the sixth transistor may include a gate electrode for receiving a light emitting control signal and the light emitting control signal may maintain an inactive state during the active period of the scan signal and the active period of the initialization scan signal.

According to one or more exemplary embodiments, the first transistor may include a gate electrode connected to the reference node.

According to one or more exemplary embodiments, the first electrode of the light emitting diode and the gate electrode of the first transistor may overlap on a plane.

According to one or more exemplary embodiments, a capacitor connected between the first voltage line and the reference node may be further included.

According to one or more exemplary embodiments, an upper electrode of the capacitor and the gate electrode of the first transistor may overlap on a plane.

According to one or more exemplary embodiments, the third transistor may include a gate electrode for receiving the scan signal.

According to one or more exemplary embodiments, a scan line for transmitting the scan signal and an initialization scan line for transmitting the initialization scan signal may be further included.

According to one or more exemplary embodiments, a previous scan line for transmitting a previous scan signal may be further included, and the fourth transistor may include a gate electrode connected to the previous scan line.

According to one or more exemplary embodiments, an active period of the previous scan signal may not overlap the active period of the scan signal.

According to one or more exemplary embodiments, each of the fifth transistor and the sixth transistor may include a gate electrode for receiving a light emitting control signal, and the light emitting control signal may maintain an inactive state during the active period of the previous scan signal, the active period of the scan signal, and the active period of the initialization scan signal.

According to one or more exemplary embodiments, the first to seventh transistors may be P-type transistors.

According to one or more exemplary embodiments, an active of each of the first to seventh transistors may include polysilicon.

According to one or more exemplary embodiments, the source electrode of the first transistor may be extended from the active of the first transistor.

According to one or more exemplary embodiments of the invention, a display device includes a display panel including a pixel and a scan driving circuit configured to output a scan signal for driving the pixel and an initialization scan signal, wherein the pixel includes a light emitting diode including a first electrode and a second electrode, a capacitor connected between a first voltage line for receiving a first power voltage and a reference node, a first transistor including a source electrode and a drain electrode, a second transistor connected between a data line and the source electrode of the first transistor and including a gate electrode for receiving a scan signal, a third transistor connected between the reference node and the drain electrode of the first transistor, a fourth transistor connected between the reference node and a second voltage line for receiving an initialization voltage, a fifth transistor connected between the first voltage line and the source electrode of the first transistor, a sixth transistor connected between the drain electrode of the first transistor and the first electrode of the light emitting diode, and a seventh transistor connected between the second voltage line and the first electrode of the light emitting diode and including a gate electrode for receiving the initialization scan signal. In an embodiment, an active period of the scan signal and an active period of the initialization scan signal may not overlap each other, and the active period of the initialization scan signal may be longer than the active period of the scan signal.

According to one or more exemplary embodiments, the sixth transistor may include a gate electrode for receiving a light emitting control signal and the light emitting control signal may maintain an inactive state during the active period of the scan signal and the active period of the initialization scan signal.

According to one or more exemplary embodiments, the first transistor may include a gate electrode connected to the reference node.

According to one or more exemplary embodiments, the first electrode of the light emitting diode and the gate electrode of the first transistor may overlap on a plane.

According to one or more exemplary embodiments, a capacitor connected between the first voltage line and the reference node may be further included.

According to one or more exemplary embodiments, an upper electrode connected to the first power line of the capacitor and the gate electrode of the first transistor may overlap on a plane.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the inventive concepts, and are incorporated in and constitute a part of this specification, illustrate exemplary embodiments of the inventive concepts and, together with the description, serve to explain principles of the inventive concepts.

DETAILED DESCRIPTION

Figure 1:
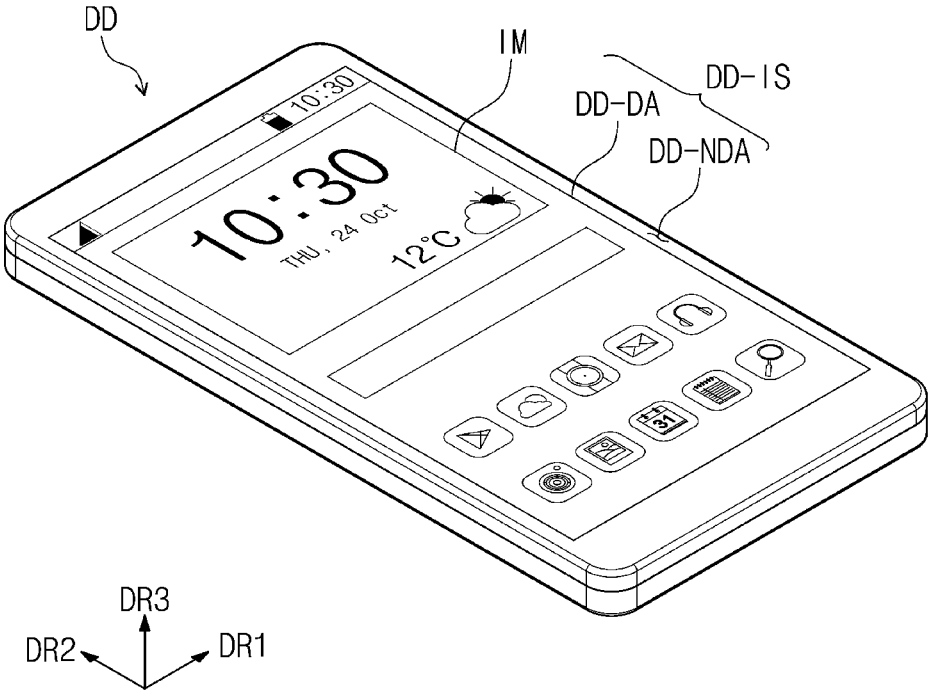
FIG. 1 is a perspective view of a display device according to an embodiment of the inventive concepts.

In the following description, for the purposes of explanation, numerous specific details are set forth in order to provide a thorough understanding of various exemplary embodiments. It is apparent, however, that various exemplary embodiments may be practiced without these specific details or with one or more equivalent arrangements. In the accompanying figures, the size and relative sizes of layers, regions, etc., may be exaggerated for clarity and descriptive purposes. Also, like reference numerals denote like elements.

When an element or layer is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. Like numbers refer to like elements throughout. As used herein, the term "and/or" includes any and all combinations of one or more of the associated listed items.

Although the terms first, second, etc. may be used herein to describe various elements, components, regions, layers, and/or sections, these elements, components, regions, layers, and/or sections should not be limited by these terms. These terms are used to distinguish one element, component, region, layer, and/or section from another element, component, region, layer, and/or section. Thus, a first element, component, region, layer, and/or section discussed below could be termed a second element, component, region, layer, and/or section without departing from the teachings of the present disclosure.

Spatially relative terms, such as "beneath," "below," "lower," "above," "upper," and the like, may be used herein for descriptive purposes, and, thereby, to describe one element or feature's relationship to another element(s) or feature(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof.

Various exemplary embodiments are described herein with reference to sectional and/or exploded illustrations that are schematic illustrations of idealized exemplary embodiments and/or intermediate structures. As such, variations from the shapes of the illustrations as a result, for example, of manufacturing techniques and/or tolerances, are to be expected. Thus, exemplary embodiments disclosed herein should not necessarily be construed as limited to the particular illustrated shapes of regions, but are to include deviations in shapes that result from, for instance, manufacturing. In this manner, regions illustrated in the drawings may be schematic in nature and the shapes of these regions may not reflect actual shapes of regions of a device and, as such, are not necessarily intended to be limiting.

As customary in the field, some exemplary embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some exemplary embodiments may be physically separated into two or more interacting and discrete blocks, units, and/or modules without departing from the scope of the inventive concepts. Further, the blocks, units, and/or modules of some exemplary embodiments may be physically combined into more complex blocks, units, and/or modules without departing from the scope of the inventive concepts.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

Hereinafter, exemplary embodiments of the inventive concept will be described with reference to the accompanying drawings.

FIG. 1 is a perspective view of a display device DD according to some exemplary embodiments.

As shown in FIG. 1, the display device DD may display an image IM through a display surface DD-IS. The display surface DD-IS is parallel to a plane defined by a first direction axis DR1 and a second direction axis DR2. The normal direction of the display surface DD-IS, that is, the thickness direction of the electronic device DD is indicated by a third direction axis DR3.

A front surface (or an upper surface) and a back surface (or a lower surface) of each component or member described hereinafter are distinguished by the third direction axis DR3. However, the first to third direction axes DR1, DR2, and DR3 shown in the present embodiment are merely exemplary. Hereinafter, first to third directions are defined as directions indicated by the first to third direction axes DR1, DR2, DR3, respectively, and are given the same reference numerals.

In an embodiment of the inventive concept, the display device DD provided with a planar display surface DD-IS is illustrated, but the embodiment of the inventive concept is not limited thereto. The display device DD may further include a curved display surface. The display apparatus DD may include a three-dimensional display surface. The three-dimensional display surface may include a plurality of display regions indicating different directions, and may include, for example, a polygonal column type display surface.

The display device DD according to the present embodiment may be a rigid display device. However, the embodiment of the inventive concept is not limited thereto. The display device DD according to the inventive concept may be a flexible display device. The flexible display device may include a foldable display device or a bending-type display device in which some portions thereof are bent.

In FIG. 1, the display device DD applicable to a cellphone terminal is exemplarily illustrated. Although not illustrated, electronic modules, a camera module, a power module and the like mounted on a main board may be disposed in a bracket/case and the like together with the display device DD to configure the cell phone terminal. The display device DD according to the inventive concept may be applicable to a large-sized electronic device such as a television and a monitor, a small-and-medium-sized electronic device such as a tablet computer, a car navigation system, a game machine, and a smart watch, and the like.

As shown in FIG. 1, the display surface DD-IS including an image region DD-DA on which the image IM is displayed, and a bezel region DD-NDA adjacent to the image region DD-DA. The bezel region DD-NDA is a region on which an image is not displayed. In FIG. 1, as an example of the image IM, icon images are illustrated.

In FIG. 1, the image region DD-DA may have a substantially quadrangular shape. The term "substantially quadrangular shape" includes not only a quadrangular shape in a mathematical sense, but also includes a quadrangular shape in which no vertex is defined in a vertex region (or corner region) but a curved boundary is defined.

The bezel region DD-NDA may have a shape surrounding the image region DD-DA. However, the embodiment of the inventive concept is not limited thereto. The shape of the image region DD-DA and the shape of the bezel region DD-NDA may be designed to have different shapes. The bezel region DD-NDA may be disposed on one side of the image region DD-DA. When the display device DD is provided in an electronic device (not shown), the bezel region DD-NDA may not be exposed to the outside according to how the display device DD and other components of the electronic device are bonded.

Figure 2:
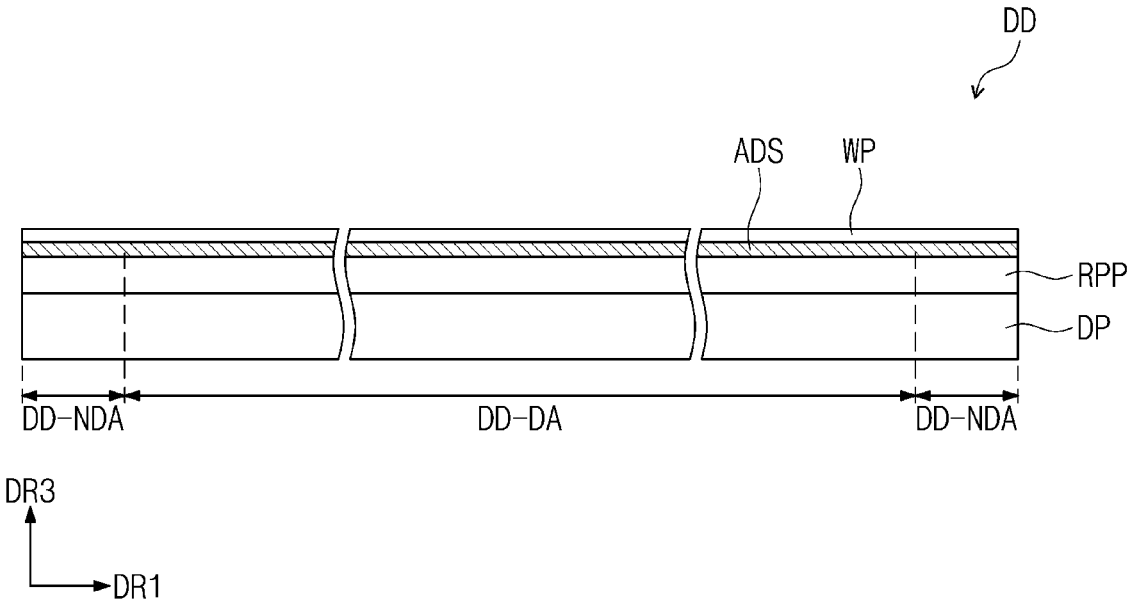
FIG. 2 is a cross-sectional view of a display device according to an embodiment of the inventive concepts.

FIG. 2 is a cross-sectional view of the display device DD according to some exemplary embodiments.

FIG. 2 illustrates a cross-section of the display device DD defined by the first direction axis DR1 and the third direction axis DR3. In FIG. 2, components of the display device DD are simply illustrated to describe the lamination relationship thereof.

The display device DD according to an embodiment of the inventive concept may include a display panel DP, an anti-reflector RPP, and a window WP. At least some components among the display panel DP, the anti-reflector RPP, and the window WP may be formed in a series of processes, or at least some components thereof may be bonded to each other through an adhesive member. An adhesive member ADS may be a transparent adhesive member such as a pressure sensitive adhesive film (PSA), an optically clear adhesive film (OCA), or an optically clear resin (OCR). The adhesive member described hereinafter may include a typical adhesive or a pressure-sensitive adhesive. In an embodiment of the inventive concept, the anti-reflector RPP and the window WP may be substituted with other components or omitted.

The display panel DP according to an embodiment of the inventive concept may be a light emitting type display panel but is not particularly limited thereto. For example, the display panel DP may be an organic display panel or a quantum dot display panel. The panels are classified according to materials constituting a light emitting element. A light emitting layer of an organic display panel may include an organic light emitting material. A light emitting layer of a quantum dot display panel may include a quantum dot and/or a quantum load, and the like. Hereinafter, the display panel DP will be described as an organic display panel.

The anti-reflector RPP reduces the reflectance of external light incident from an upper side of the window WP. The anti-reflector RPP according to an embodiment of the inventive concept may include a phase retarder and a polarizer. The phase retarder may be a film type or a liquid crystal coating type and may include a $\lambda/2$ phase retarder and/or a $\lambda/4$ phase retarder. The polarizer may also be of a film type or a liquid crystal coating type. The film type polarizer may include a synthetic resin film, and the liquid crystal coating type polarizer may include liquid crystals arranged in a predetermined arrangement. The phase retarder and the polarizer may further include a protective film. The phase retarder and the polarizer themselves or the protective film may be defined as a base layer of the anti-reflector RPP.

The anti-reflector RPP according to an embodiment of the inventive concept may include color filters. The color filters have a predetermined arrangement. The arrangement of the color filters may be determined in consideration of the light emitting colors of pixels included in the display panel DP. The anti-reflector RPP may further include a black matrix adjacent to the color filters.

The anti-reflector RPP according to an embodiment of the inventive concept may include a destructive interference structure. For example, the destructive interference structure may include a first reflective layer and a second reflective layer disposed on different layers. First reflective light and second reflective light respectively reflected from the first reflective layer and the second reflective layer may be destructively interfered, and accordingly, the reflectance of external light is reduced.

The window WP according to an embodiment of the inventive concept may include a glass substrate and/or a synthetic resin film, and the like. The window WP is not limited to a single layer. The window WP may include two or more films bonded with an adhesive member. Although not separately illustrated, the window WP may further include a functional coating layer. The functional coating layer may include an anti-fingerprint layer, an anti-reflection layer, a hard coating layer, and the like.

Figure 3:
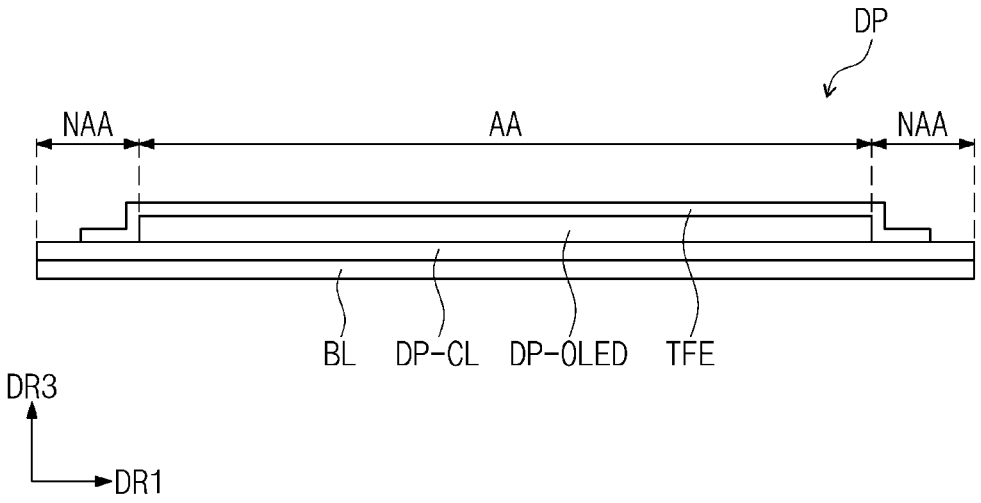
FIG. 3 is a cross-sectional view of the display panel shown in FIG. 2.

FIG. 3 is a cross-sectional view of the display panel DP shown in FIG. 2.

As illustrated in FIG. 3, the display panel DP includes a base layer BL, a circuit element layer DP-CL disposed on the base layer BL, a light emitting element layer DP-OLED, and a thin film encapsulation layer TFE. An active region AA and a peripheral region NAA corresponding to the image region DD-DA and the bezel region DD-NDA illustrated in FIG. 1 may be defined in the display panel DP. As used herein, the sentence "a region/portion corresponds to a region/portion" means "they overlap each other," but is not limited to having the same area and/or the same shape.

The base layer BL may include at least one synthetic resin film. The base layer BL may include a glass substrate, a metal substrate, an organic/inorganic composite material substrate, or the like.

On the base layer BL, the circuit element layer DP-CL is disposed. The circuit element layer DP-CL includes at least one insulation layer and circuit elements. The insulation layer includes at least one inorganic layer and at least one organic layer. The circuit elements may include signal lines, a pixel driving circuit, and the like.

On the circuit element layer DP-CL, the light emitting element layer DP-OLED is disposed. The light emitting element layer DP-OLED is a light emitting element and includes organic light emitting diodes. The light emitting element layer DP-OLED may further include an organic layer such as a pixel definition film.

A thin film encapsulation layer TFE may be disposed on the light emitting element layer DP-OLED and encapsulate the light emitting element layer DP-OLED. The thin film encapsulation layer TFE may cover the entire active region AA. The thin film encapsulation layer TFE may cover a portion of the peripheral region NAA.

The thin film encapsulation layer TFL includes a plurality of thin films. Some thin films are disposed to improve optical efficiency, and some thin films are disposed to protect organic light emitting diodes. The thin film encapsulation layer TFE will be described in detail later.

Figure 4:
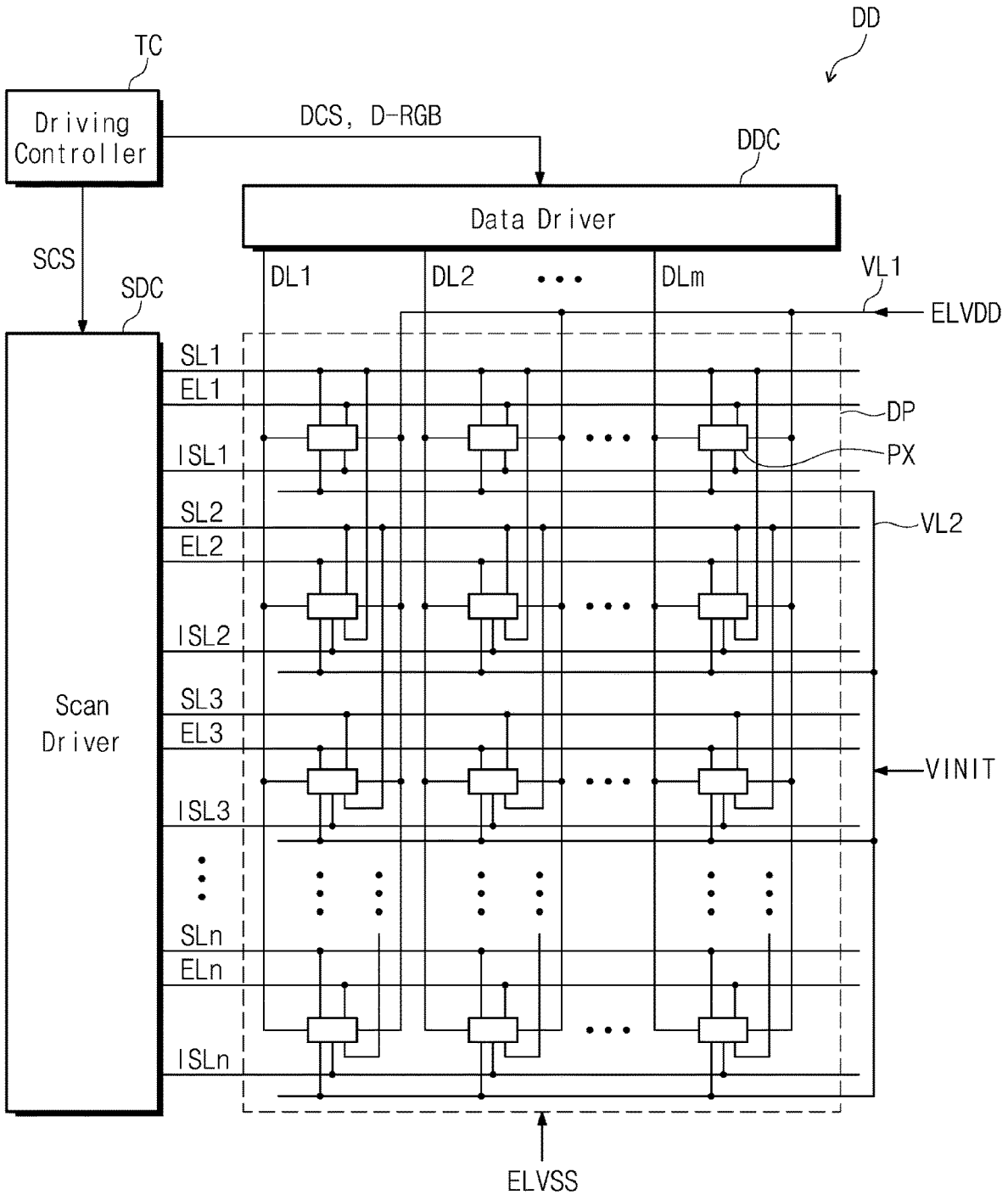
FIG. 4 is a block diagram of a display device according to an embodiment of the inventive concepts.

FIG. 4 is a block diagram of the display device DD according to some exemplary embodiments. The display device DD includes a driving controller TC, a scan driver SDC, a data driver DDC, and the display panel DP. In the present embodiment, the display panel DP will be a light emitting type display panel. The light emitting type display panel may include an organic display panel or a quantum dot display panel.

The driving controller TC receives input image signals and converts a data format of the input image signals to match interface specifications of the scan driver SDC to generate image data D-RGB. The driving controller TC outputs the image data D-RGB and control signals DCS and SCS.

The scan driver SDC receives a scan control signal SCS from the driving controller TC. The scan control signal SCS may include a vertical initiation signal and clock signals for initiating the operation of the scan driver SDC. The scan driver SDC generates a plurality of scan signals and initialization scan signals and sequentially outputs the same to signal lines SL1 to SLn and ISL1 to ISLn. Also, the scan driver SDC generates a plurality of light emission control signals in response to the scan control signal SCS, and outputs the plurality of light emission control signals to corresponding light emission control lines EL1 to ELn.

In FIG. 4, a plurality of scan signals and a plurality of light emission control signals are illustrated as being output from one scan driver SDC, but the embodiment of the inventive concept is not limited thereto. In an embodiment of the inventive concept, a plurality of scan drivers may divide, generate, and output scan signals, and may divide, generate, and output a plurality of light emission control signals. In addition, in an embodiment of the inventive concept, a driving circuit for generating and outputting a plurality of scan signals and a driving circuit for generating and outputting a plurality of light emission control signals may be classified separately.

A data driver DDC receives a data control signal DCS and the image data D-RGB from the driving controller TC. The data driver DDC converts the image data D-RGB into data signals and output the data signals to a plurality of data lines DL1 to DLm to be described later. The data signals may have voltage levels corresponding to gray scale values of the image data D-RGB.

The display panel DP includes scan lines SL1 to SLn, initialization scan lines GL1 to GLn, the light emission control lines EL1 to ELn, data lines DL1 to DLm, a first voltage line VL1, a second voltage line VL2, and a plurality of pixels PX. Scan lines of a first group SL1 to SLn, scan lines of a second group GL1 to GLn, scan lines of a third group HL1 to HLn, and the light emission control lines EL1 to ELn are extended to a first direction DR1 and arranged in a second direction DR2 crossing the first direction DR1.

The plurality of data lines DL1 to the DLm cross the scan lines of the first group SL1 to SLn, the scan lines of the second group GL1 to GLn, the scan lines of the third group HL1 to HLn, and the light emission control lines EL1 to ELn while being insulated therefrom. Each of the plurality of pixels PX is connected to corresponding signal lines among the signal lines. The connection relationship between the pixels PX and the signal lines may be changed according to the configuration of a driving circuit of the pixels PX.

The first voltage line VL1 receives a first power voltage ELVDD. The second voltage line VL2 receives an initialization voltage VINIT. The initialization voltage VINIT has a lower level than the first power voltage ELVDD. A second power voltage ELVSS is applied to the display panel DP. The second power voltage ELVSS has a lower level than the first power voltage ELVDD.

In the above, the display device DD according to an embodiment has been described with reference to FIG. 4, but a display device of the inventive concept is not limited thereto. Signal lines may be further added or omitted according to the configuration of a circuit in the pixel PX. In addition, the connection relationship between one pixel PX and the signal lines may be changed.

The plurality of pixels PX may include a plurality of groups for generating different color lights. For example, the pixels may include red pixels for generating red color light, green pixels for generating green color light, and blue pixels for generating blue color light. A light emitting diode of a red pixel, a light emitting diode of a green pixel, and a light emitting diode of a blue pixel may include a light emitting layer of different materials.

Each of the plurality of pixels PX may include a pixel driving circuit. The pixel driving circuit may include a plurality of transistors and a capacitor electrically connected to the transistors. At least one of the scan driver SDC and the data driver DDC may include a plurality of transistors formed through the same process as a process for forming the pixel driving circuit.

Through a plurality of photolithography processes, the scan lines, the plurality of pixels PX, the scan driver SDC, and the data driver DDC may be formed on the base layer BL (see FIG. 3). Through a plurality of deposition processes or coating processes, a plurality of insulation layers may be formed on the base layer BL. The plurality of insulation layers may be a thin film disposed to correspond to the plurality of pixels PX, and some of the plurality of insulation layers may include an insulation pattern overlapping a particular conductive pattern. The insulation layers include an organic layer and/or an inorganic layer.

Figure 5:
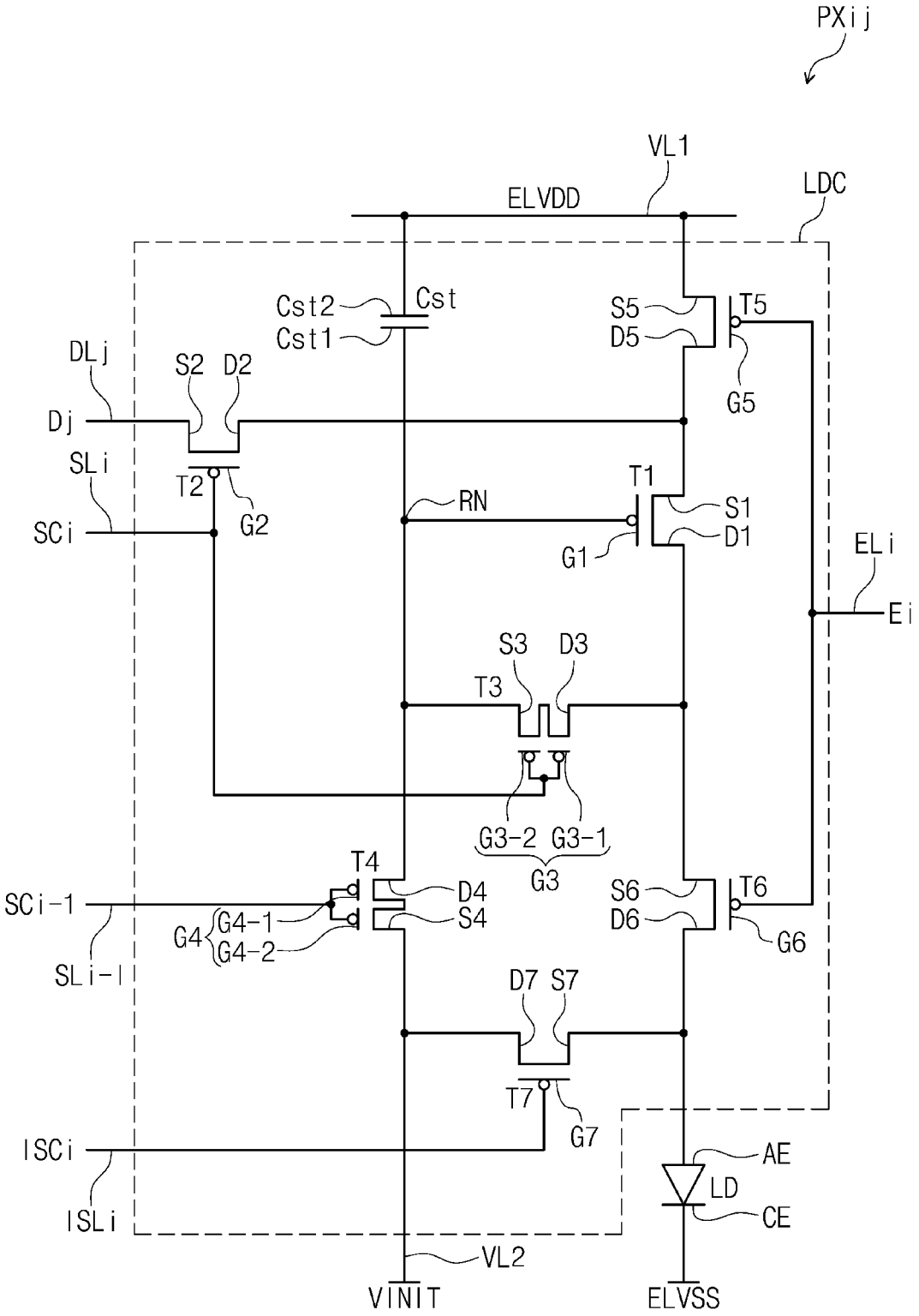
FIG. 5 is an equivalent circuit diagram of a pixel according to an embodiment of the inventive concepts.
Figure 6:
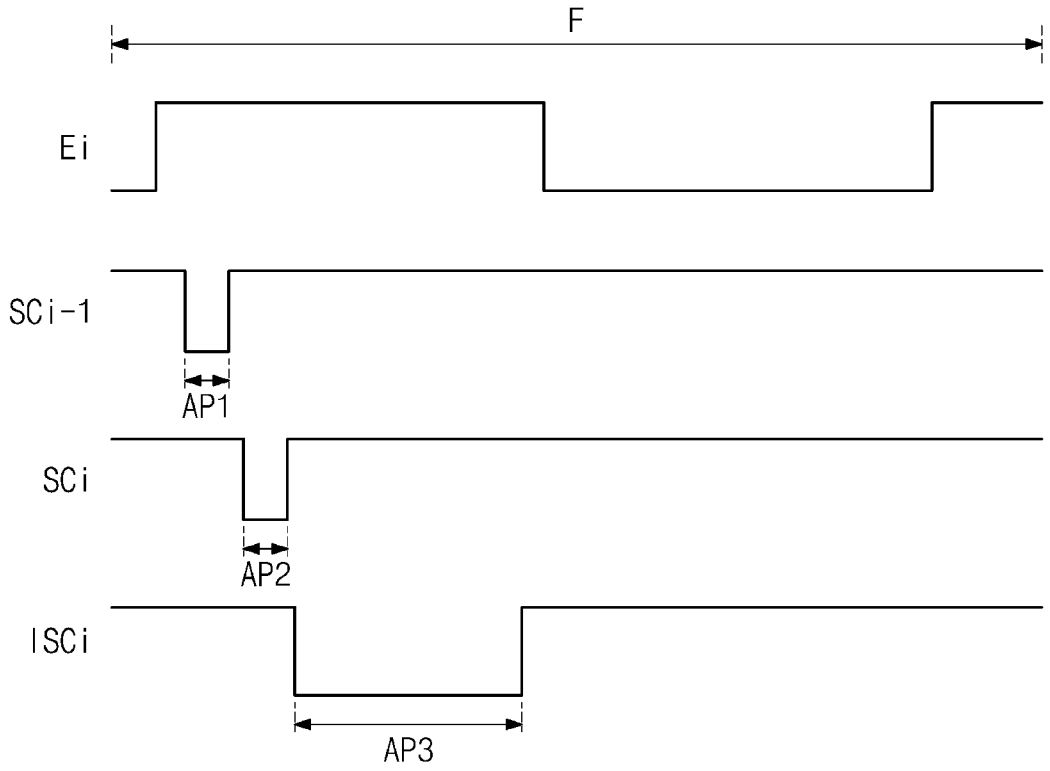
FIG. 6 is a waveform diagram of driving signals for driving the pixels shown in FIG. 5.

FIG. 5 is an equivalent circuit diagram of a pixel PXij according to some exemplary embodiments. FIG. 6 is a waveform diagram of driving signals for driving the pixel PXij shown in FIG. 5.

FIG. 5 exemplarily illustrates the pixel PXij which is connected to an i-th scan like SLi among the scan lines SL1 to SLn and to a $j^{th}$ data line DLj among the plurality of data lines DL1 to DLm.

In the present embodiment, a pixel driving circuit LDC may include first to seventh transistors T1 to T7 and a capacitor Cst. In the present embodiment, the first to seventh transistors T1 to T7 are described to be P-type transistors. However, the embodiment of the inventive concept is not limited thereto. The first to seventh transistors T1 to T7 may be implemented as either P-type transistors or N-type transistors. Also, in an embodiment of the inventive concept, at least one of the first to seventh transistors T1 to T7 may be omitted.

In the present embodiment, a first transistor T1 may be a driving transistor, and the second to seventh transistors T2 to T7 may be switching transistors. The capacitor Cst is connected between the first voltage line VL1 receiving the first power voltage ELVDD and a reference node RN. The capacitor Cst includes a first electrode Cst1 connecting to the reference node RN and a second electrode Cst2 connecting to the first voltage line VL1.

The first transistor T1 is connected between the first voltage line VL1 and an anode AE of a light emitting diode LD. A source electrode S1 of the first transistor T1 is electrically connected to the first voltage line VL1. In the present disclosure, "being electrically connected between a transistor and a signal line or between a transistor and a transistor" means that "a source electrode, a drain electrode, and a gate electrode of a transistor have an integral shape with a signal line or are connected through a connection electrode." Between the source electrode S1 of the first transistor T1 and the first voltage line VL1, another transistor may be disposed or omitted.

A drain electrode D1 of the first transistor T1 is electrically connected to the anode AE of the light emitting diode LD. Between the drain electrode D1 of the first transistor T1 and the anode AE of the light emitting diode LD, another transistor may be disposed or omitted. A gate electrode G1 of the first transistor T1 is electrically connected to the reference node RN.

A second transistor T2 is connected between the $j^{th}$ data line DLj and the source electrode S1 of the first transistor T1. A source electrode S2 of the second transistor T2 is electrically connected to the $j^{th}$ data line DLj, and a drain electrode D2 of the second transistor T2 is electrically connected to the source electrode S1 of the first transistor T1. In the present embodiment, a gate electrode G2 of the second transistor T2 may be electrically connected to the i-th scan line SLi.

A third transistor T3 is connected between the reference node RN and the drain electrode D1 of the first transistor T1. A drain electrode D3 of the third transistor T3 is electrically connected to the drain electrode D1 of the first transistor T1, and a source electrode S3 of the third transistor T3 is electrically connected to the reference node RN. The third transistor T3 may include a plurality of gate electrodes. In the present embodiment, the third transistor T3 includes two gate electrodes G3-1 and G3-2, and the gate electrodes G3-1 and G3-2 may be electrically connected to an i-th scan line SLi. The two gate electrodes G3-1 and G3-2 of the third transistor T3 may be denoted by one gate electrode G3. In an embodiment of the inventive concept, the third transistor T3 may include a single gate electrode.

A fourth transistor T4 is connected between the reference node RN and the second voltage line VL2. A drain electrode D4 of the fourth transistor T4 is electrically connected to the reference node RN, and a source electrode S4 of the fourth transistor T4 is electrically connected to the second voltage line VL2. The fourth transistor T4 may include a plurality of gate electrodes. In an embodiment of the inventive concept, the fourth transistor T4 may include a single gate electrode.

In the present embodiment, two gate electrodes G4-1 and G4-2 of the fourth transistor T4 may be electrically connected to an i-1$^{st}$ scan line SLi-1. The two gate electrodes G4-1 and G4-2 of the fourth transistor T4 may be denoted by one gate electrode G4. Since each the third transistor T3 and the fourth transistor T4 has a plurality of gate electrodes, the leakage current of the pixel PXij may be reduced.

A fifth transistor T5 is connected between the first voltage line VL1 and the source electrode S1 of the first transistor T1. A source electrode S5 of the fifth transistor T5 is electrically connected to the first voltage line VL1, and a drain electrode D5 of the fifth transistor T5 is electrically connected to the source electrode S1 of the first transistor T1. A gate electrode G5 of the fifth transistor T5 may be electrically connected to an i-th light emission control line ELi.

A sixth transistor T6 is connected between the drain electrode D1 of the first transistor T1 and the light emitting diode LD. A source electrode S6 of the sixth transistor T6 is electrically connected to the drain electrode D1 of the first transistor T1, and a drain electrode D6 of the sixth transistor T6 is electrically connected to the anode AE of the light emitting diode LD. A gate electrode G6 of the sixth transistor T6 may be electrically connected to an i-th light emission control line ELi. In an embodiment of the inventive concept, the gate electrode G6 of the sixth transistor T6 may be connected to a different signal line from the gate electrode G5 of the fifth transistor T5.

A seventh transistor T7 is connected between the drain electrode D6 of the sixth transistor T6 and the second voltage line VL2. A source electrode S7 of the seventh transistor T7 is electrically connected to the drain electrode D6 of the sixth transistor T6, and a drain electrode D7 of the sixth transistor T7 is electrically connected to the second voltage line VL2. The gate electrode G7 of the seventh transistor T7 may be electrically connected to an i+1$^{st}$ scan line SLi+1 of the first group.

A cathode CE of the light emitting diode LD may be connected to a terminal for transmitting the second driving voltage ELVSS. A structure of the pixel PXij according to an embodiment is not limited to the structure shown in FIG. 5. The number of transistors and capacitors included in one pixel PX and the connection relationship thereof may be variously modified.

Referring to FIG. 6 together with FIG. 5 described above, the operation of a display device according to an embodiment will be described.

Referring FIG. 5 and FIG. 6, during an initialization period within one frame F, a previous scan signal SCi-1 of a low level is supplied through the scan line SLi. In response to the previous scan signal SCi-1, the fourth transistor T4 is turned on. Through the fourth transistor T4, the initialization voltage VINIT is transmitted to the gate electrode G1 of the first transistor T1 to initialize the first transistor T1.

Next, during data programing and a compensation period, when a scan signal SCi of a low level is supplied through the scan line SLi, the second transistor T2 is turned on, and at the same time, the third transistor T3 is turned on. At this time, the first transistor T1 is diode-connected by the turned-on third transistor T3 and is biased in a forward direction. Then, a compensation voltage Dj-Vth reduced by a threshold voltage Vth of the first transistor T1 from the data signal Dj supplied from the data line DLj is applied to a gate electrode of the first transistor T1. That is, a gate voltage applied to the gate electrode of the first transistor T1 may be a compensation voltage Dj-Vth.

To the first electrode Cst1 and the second electrode Cst 2 of the capacitor Cst, the first driving voltage ELVDD and the compensation voltage Dj-Vth are respectively applied, and in the capacitor Cst, electric charges corresponding to the voltage difference between the first driving voltage ELVDD and the compensation voltage Dj-Vth may be stored.

During a bypass period, the seventh transistor T7 is turned on by being supplied with an initialization scan signal ISCi of a low level through an initialization scan line ISLi. A portion of a driving current Id may exit through the seventh transistor T7 as a bypass current by the seventh transistor T7.

If the light emitting diode LD emits light even when a minimum current of the first transistor T1 for displaying a black image flows as a driving current, the black image is not properly displayed. Accordingly, the seventh transistor T7 of an organic light emitting display device according to an embodiment of the inventive concept may disperse a portion of the minimum current of the first transistor T1 as a bypass current Ibp into a current path other than a current bath on the light emitting diode LD side. Here, the minimum current of the first transistor T1 refers to a current under a condition in which the first transistor is turned off since a gate-source electrode voltage Vgs of the first transistor T1 is less than the threshold voltage Vth. As such, the minimum driving current under the condition in which the first transistor T1 is turned off (for example, a current of 10 pA or less) is transmitted to the light emitting diode LD and displayed as an image of black luminance. When the minimum driving current for displaying a black image flows, the effect of the bypass transmission of the bypass current Ibp is significant. However, when a large driving current for displaying an image, such as a normal image or a white image, flows, there is little effect of the bypass current Ibp. Accordingly, when a driving current for displaying a black image flows, a light emitting current Ted of the light emitting diode LD reduced by the amount of current of the bypass current Ibp exiting through the seventh transistor T7 from the driving current Id may have a minimum amount of current to a level so as to reliably display the black image. Accordingly, an image of correct black luminance may be implemented using the seventh transistor T7 to improve a contrast ratio.

Next, during a light emitting period, a light emission control signal Ei supplied from the i-th light emission control line ELi is changed from a high level to a low level. During the light emitting period, the fifth transistor T5 and the sixth transistor T6 are turned on by the light emission control signal Ei of a low level. Then, the driving current Id corresponding to the voltage difference between a gate voltage of the gate electrode G1 of the first transistor T1 and the first driving voltage ELVDD is generated, and through the sixth transistor T6, the driving current Id is supplied to the light emitting diode LD to allow the current Ied to flow in the light emitting diode LD. During the light emitting period, the gate-source electrode voltage Vgs of the first transistor T1 is maintained as '(Dj-Vth)-ELVDD' by the capacitor Cst, and according to the current-voltage relationship of the first transistor T1, the driving current Id may be proportional to the square of a value obtained by subtracting the threshold voltage Vth from a driving gate-source electrode voltage '$(Dj\text{-}ELVDD)^2$.' Accordingly, the driving current Id may be determined regardless of the threshold voltage Vth of the first transistor T1.

In an example shown in FIG. 6, a first active period AP1 in which the previous scan signal SCi-1 is of a low level, a second active period AP2 in which the scan signal SCi is of a low level, and a third active period AP3 in which the initialization scan signal ISCi is of a low level do not overlap in time. The first active period AP1 of the previous scan signal SCi-1 precedes the second active period AP2 of the scan signal SCi. In addition, the third active period AP3 of the initialization scan signal ISCi is longer than the second active period AP2 of the scan signal SCi.

The light emission control signal Ei is maintained in an inactive state, that is, at a high level during the first active period AP1 of the previous scan signal SCi-1, the second active period AP2 of the scan signal SCi, and the third active period of the initialization scan signal ISCi. In other words, the third active period of the initialization scan signal ISCi may be maintained from when the second active section AP2 of the scan signal SCi is terminated to when the light emission control signal Ei transitions from a high level to a low level.

Referring to FIG. 5, in a high temperature environment, the off-leakage current of the first to seventh transistors T1 to T7 may increase. When a leakage current increases in an off state of the second transistor T2, the first transistor T1, and the sixth transistor T6, the amount of current of the anode AE of the light emitting diode LD may change. As the amount of current of the anode AE of the light emitting diode LD changes, the light emission luminance of the light emitting diode LD may change.

As described above, electric charges corresponding to the difference between the first driving voltage ELVDD and the compensation voltage Dj-Vth are stored in the capacitor Cst during the data programming and the compensation period, and during the bypass period, a portion of the driving current Id may exit through the seventh transistor T7 as a bypass current by the seventh transistor T7.

As illustrated in FIG. 6, the voltage of the anode AE of the light emitting diode LD may be maintained at the initialization voltage VINIT by maintaining the bypass period, that is, the third active period AP3 of the initialization scan signal ISCi, long before the light emission period.

Figure 7:
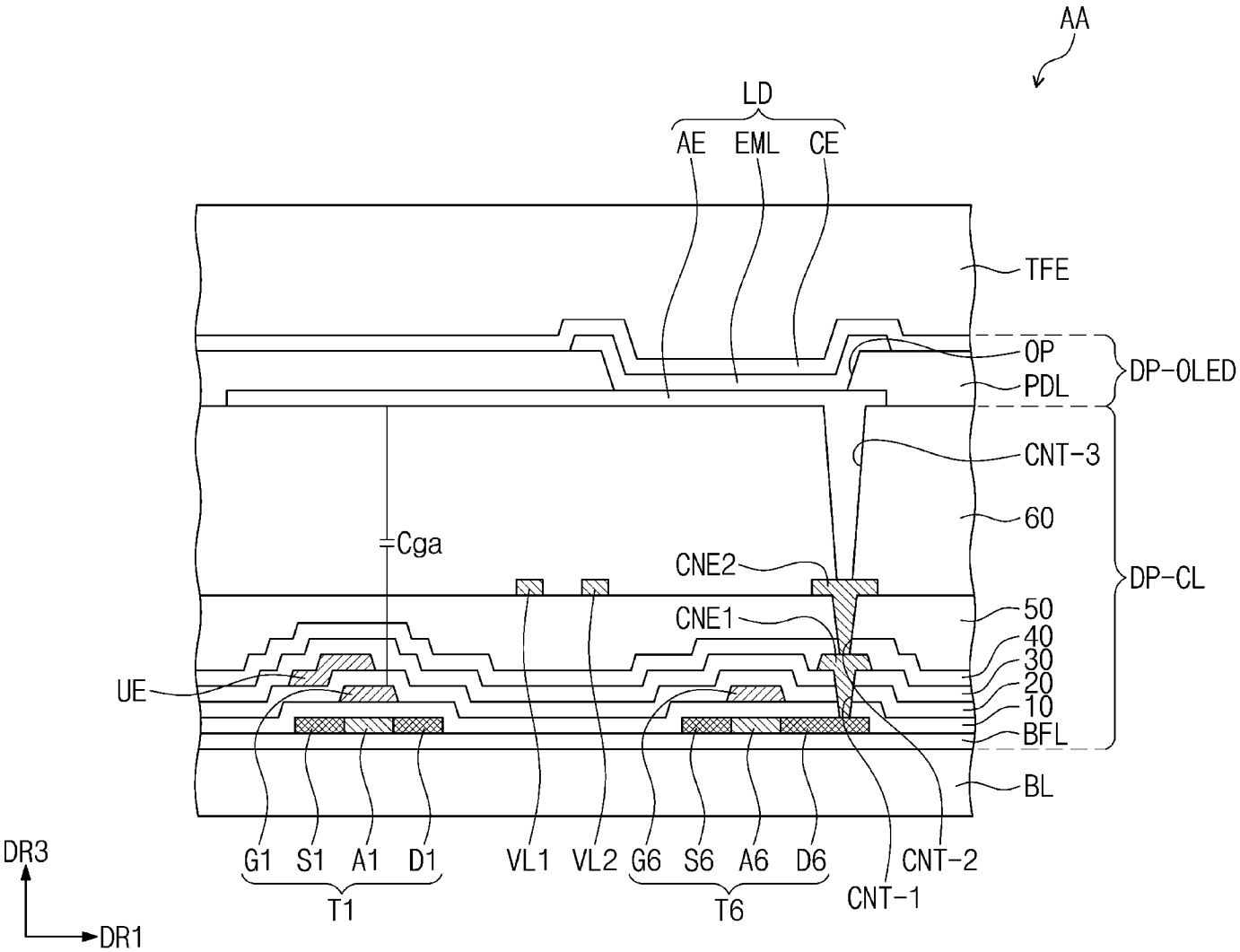
FIG. 7 is a cross-sectional view of an active region of a display panel according to an embodiment of the inventive concepts.

FIG. 7 is a cross-sectional view of the active region AA of the display panel DP according to some exemplary embodiments. FIG. 7 illustrates a cross-section of a portion corresponding to the first transistor T1 and the sixth transistor T6 illustrated in FIG. 5.

Referring to FIG. 7, the display panel DP may include the base layer BL, the circuit element layer DP-CL disposed on the base layer BL, the light emitting element layer DP-OLED, and the thin film encapsulation layer TFE. The display panel DP may further include functional layers such as a refractive index control layer. The circuit element layer DP-CL includes at least a plurality of insulation layers and a circuit element. Hereinafter, the insulation layers may include an organic layer and/or an inorganic layer.

An insulation layer, a semi-conductor layer, and a conductive layer are formed by coating, deposition, and the like. Thereafter, the insulating layer, the semiconductor layer, and the conductive layer may be selectively patterned by photolithography. In this manner, a semiconductor pattern, a conductive pattern, a signal line, and the like are formed.

The base layer BL may include a synthetic resin film. A synthetic resin layer may include a thermosetting resin. In particular, the synthetic resin layer may be a polyimide-based resin layer, and the material thereof is not particularly limited. The synthetic resin layer may include at least any one of an acrylic resin, a methacrylic resin, polyisoprene, a vinyl-based resin, an epoxy-based resin, a urethane-based resin, a cellulose-based resin, a siloxane-based resin, a polyamide-based resin, and a perylene-based resin. In addition, the base layer may include a glass substrate, a metal substrate, an organic/inorganic composite substrate, or the like.

At least one inorganic layer is formed on an upper surface of the base layer BL. The inorganic layer may include at least one of an aluminum oxide, a titanium oxide, a silicon oxide, silicon oxynitride, a zirconium oxide, and a hafnium oxide. The inorganic layer may be formed of multiple layers. At least one of inorganic layers of multiple layers may constitute a buffer layer BFL.

The buffer layer BFL improves the bonding force between the base layer BL and the semiconductor pattern and/or the conductive pattern. The buffer layer BFL may include a silicon oxide layer and a silicon nitride layer. The silicon oxide layer and the silicon nitride layer may be alternately stacked.

The semiconductor pattern is disposed on the buffer layer BFL. The semiconductor pattern may be directly disposed on the buffer layer BFL. The semiconductor pattern may include a silicon semiconductor. The semiconductor pattern may include polysilicon. However, the embodiment of the inventive concept is not limited thereto, and the semiconductor pattern may include amorphous silicon.

FIG. 7 illustrates only a portion of the semiconductor pattern. The semiconductor pattern may be further disposed in another region of the pixel PXij (see FIG. 5). The semiconductor pattern has different electrical properties depending on whether the semiconductor pattern is doped. The semiconductor pattern may include a doped region and a non-doped region. The doped region may be doped with an N-type dopant or a P-type dopant. A P-type transistor includes a doped region doped with the P-type dopant.

The doped region has higher conductivity than the non-doped region and has substantially the role of an electrode or a signal line. The non-doped region substantially corresponds to an active region (or channel) of a transistor. In other words, a portion of the semiconductor pattern may be the active region of the transistor, another portion thereof may be a source electrode or a drain electrode of the transistor, and the other portion thereof may be a connection electrode or a connection signal line (or connection electrode).

As shown in FIG. 7, the source electrode Si, an active region A1, and the drain electrode D1 of the first transistor T1 are formed from a semiconductor pattern. The source electrode S1 and the drain electrode D1 of the first transistor T1 are extended in an opposite direction from the active region A1. In addition, the source electrode S6, an active region A6, and the drain electrode D6 of the sixth transistor T6 are formed from a semiconductor pattern. The source electrode S6 and the drain electrode D6 of the sixth transistor T6 are extended in an opposite direction from the active layer A6. Although not separately illustrated, the source electrode S6 of the sixth transistor T6 may be connected to the drain electrode D1 of the first transistor Ti.

A first insulation layer 10 is disposed on the buffer layer BFL. The first insulation layer 10 commonly overlaps the plurality of the pixels PX (see FIG. 4) and covers the semiconductor pattern. The first insulation layer 10 may be an inorganic layer and/or an organic layer and may have a single-layered structure or a multi-layered structure. The first insulation layer 10 may include at least one of an aluminum oxide, a titanium oxide, a silicon oxide, silicon oxynitride, a zirconium oxide, and a hafnium oxide. In the present embodiment, the first insulation layer 10 may be a silicon nitride layer of a single layer. Not only the first insulation layer 10 but also an insulation layer of the circuit element layer DP-CL to be described layer may be an inorganic layer and/or an organic layer and may have a single-layered structure or a multi-layered structure. An inorganic layer may include at least one of the above-described materials.

On the first insulation layer 10, the gate electrode G1 of the first transistor T1 is disposed. The gate electrode G1 may be a portion of a metal pattern. The gate electrode G1 of the first transistor T1 overlaps the active region A1 of the first transistor Ti. In a process of doping the semiconductor pattern, the gate electrode G1 of the first transistor T1 is like a mask.

On the first insulation layer 10, a second insulation layer 20 for covering the gate electrode G1 is disposed. The second insulation layer 20 commonly overlaps the plurality of the pixels PX (see FIG. 1). The second insulation layer 20 may be an inorganic layer and/or an organic layer and may have a single-layered structure or a multi-layered structure. In the present embodiment, the second insulation layer 20 may be a silicon oxide layer of a single layer.

On the second insulation layer 20, an upper electrode UE may be disposed. The upper electrode UE may overlap the gate electrode G1. The upper electrode UE may be a portion of a metal pattern or a portion of a doped semiconductor pattern. A portion of the gate electrode G1 and the upper electrode UE overlapping the same may define the capacitor Cst (see FIG. 5). In an embodiment of the inventive concept, the upper electrode UE may be omitted. In an embodiment of the inventive concept, the second insulation layer 20 may be substituted with an insulation pattern.

Although not separately illustrated, the first electrode Cst1 and the second electrode Cst2 of the capacitor Cst (see FIG. 5) may be formed through the same process as a process for forming the gate electrode G1 and the upper electrode UE. On the first insulation layer 10, the first electrode Cst1 may be disposed. The first electrode Cst1 may be electrically connected the gate electrode G1. The first electrode Cst1 may have an integral shape with the gate electrode G1.

On the second insulation layer 20, the second electrode Cst2 may be disposed. The second electrode Cst2 may be electrically connected to the upper electrode UE. The second electrode Cst2 may have an integral shape with the upper electrode UE.

On the second insulation layer 20, a third insulation layer 30 for covering the upper electrode UE is disposed. In the present embodiment, the third insulation layer 30 may be a silicon oxide layer of a single layer. Although not separately illustrated and described, the source electrodes S2 to S7 (see FIG. 5), the drain electrodes D2 to D7 (see FIG. 5) and the gate electrodes G2 to G7 (See FIG. 5) of the second to seventh transistors T2 to T7 (see FIG. 5). 5 may be formed through the same process as a process for forming the source electrode S1, the drain electrode D1, and the gate electrode G1 of the first transistor T1.

On the third insulation layer 30, a first connection electrode CNE1 may be disposed. The first connection electrode CNE1 may be connected to the drain electrode D6 of the sixth transistor T6 through a contact hole CNT-1 passing through the first to third insulation layers 10 to 30.

On the third insulation layer 30, a fourth insulation layer 40 for covering the first connection electrode CNE1 may be disposed. The fourth insulation layer 40 may be a silicon oxide layer of a single layer. On the fourth insulation layer 40, a fifth insulation layer 50 is disposed. The fifth insulation layer 50 may be an organic layer. On the fifth insulation layer 50, a second connection electrode CNE2 may be disposed. The second connection electrode CNE2 may be connected to the first connection electrode CNE1 through a contact hole CNT-2 passing through the fourth insulation layer 40 and the fifth insulation layer 50.

On the fifth insulation layer 50, a sixth insulation layer 60 for covering the second connection electrode CNE2 is disposed. The sixth insulation layer 60 may be an organic layer. On the sixth insulation layer 60, the anode AE is disposed. The anode AE is connected to the second connection electrode CNE2 through a contact hole CNT-3 passing through the sixth insulation layer 60. On a pixel definition film PDL, an opening OP is defined. The opening OP of the pixel definition film PDL exposes at least a portion of the anode AE.

The first voltage line VL1 (see FIG. 5) and the second voltage line VL2 (see FIG. 5) may be disposed on the fifth insulation layer 50. The first voltage line VL1 (see FIG. 5) and the second voltage line VL2 (see FIG. 5) may be formed of the same material.

On the anode AE, a light emitting layer EML is disposed. The light emitting layer EML may be disposed only in a region corresponding to the opening OP. The light emitting layer EML may be divided and formed in each of the plurality of pixels PX.

In the present embodiment, although a patterned light emitting layer EML is exemplarily illustrated, but the light emitting layer EML may be commonly disposed in the plurality of pixels PX. At this time, the light emitting layer EML may generate white light or blue light. In addition, the light emitting layer EML may have a multi-layered structure. On the light emitting layer EML, the cathode CE is disposed. The cathode CE is commonly disposed in the plurality of pixels PX.

Although not illustrated in the drawings, a hole control layer may be disposed between the anode AE and the light emitting layer EML. In addition, an electron control layer may be disposed between the light emitting layer EML and the cathode CE.

The thin film encapsulation layer TFE is disposed on the cathode CE. The thin film encapsulation layer TFE is commonly disposed in the plurality of pixels PX. In the present embodiment, the thin film encapsulation layer TFE directly covers the cathode CE. In an embodiment of the inventive concept, a capping layer for directly covering the cathode CE may be further disposed.

The thin film encapsulation layer TFE includes at least an inorganic layer or an organic layer. In one embodiment of the present invention, the thin film encapsulation layer TFE may include two inorganic layers and an organic layer disposed therebetween. In an embodiment of the inventive concept, the thin film encapsulation layer TFE may include a plurality of inorganic layers and a plurality of organic layers which are alternately stacked.

An encapsulation inorganic layer protects the light emitting diode LD from moisture/oxygen, and an encapsulation organic layer protects the light emitting diode LD from foreign matters such as dust particles. The encapsulation inorganic layer may include a silicon nitride layer, a silicon oxynitride layer, a silicon oxide layer, a titanium oxide layer, an aluminum oxide layer, or the like, but the embodiment of the inventive concept is not particularly limited thereto. The encapsulation organic layer may include an acrylic organic layer, but the embodiment of the inventive concept is not particularly limited thereto.

In an exemplary embodiment, the gate electrode G1 of the first transistor T1 may form a capacitance Cga by overlapping the anode AE of the light emitting diode LD. The capacitance Cga may change a signal provided to the gate electrode G1 of the first transistor T1.

As described above, the voltage of the anode AE of the light emitting diode LD may be maintained at the initialization voltage VINIT by maintaining the bypass period, that is, the third active period AP3 of the initialization scan signal ISCi, long before the light emission period. Therefore, it is possible to prevent the signal provided to the gate electrode G1 of the first transistor T1 from changing due to the change in the capacitance Cga according to the off-leakage current of the first to sixth transistors T1 to T6 and/or the on/off of the seventh transistor T7.

Referring back to FIG. 5 and FIG. 6, since the change in the capacitance Cga due to the off-leakage current of the first to sixth transistors T1 to T6 may be prevented, the voltage range of the scan signals SCi and SCi-1 for controlling the on/off of the first to seventh transistors T1 to T7 may be lowered. Since the voltage level of the high level of the scan signals SCi and SCi-1 may be lowered, power consumption in the display device DD may be reduced.

Figure 8A:
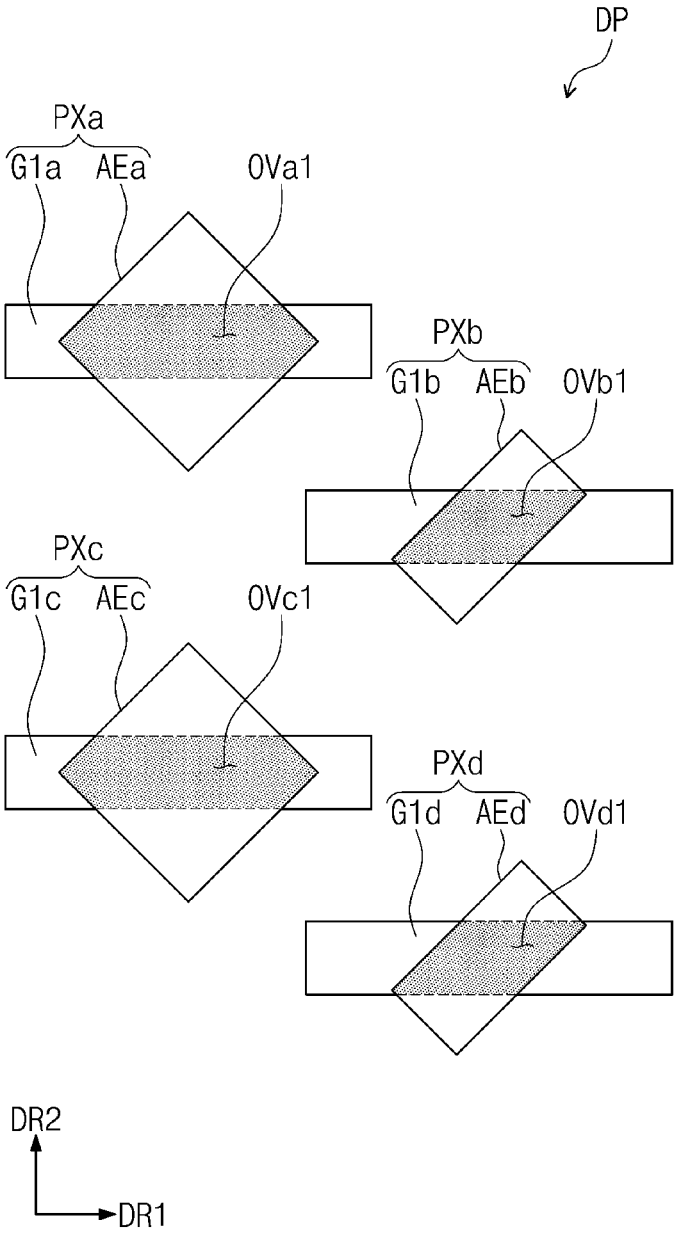
FIG. 8A and FIG. 8B are plan views exemplarily showing the overlapping of a gate electrode of a first transistor and an anode of a light emitting diode illustrated in FIG. 7.
Figure 8B:
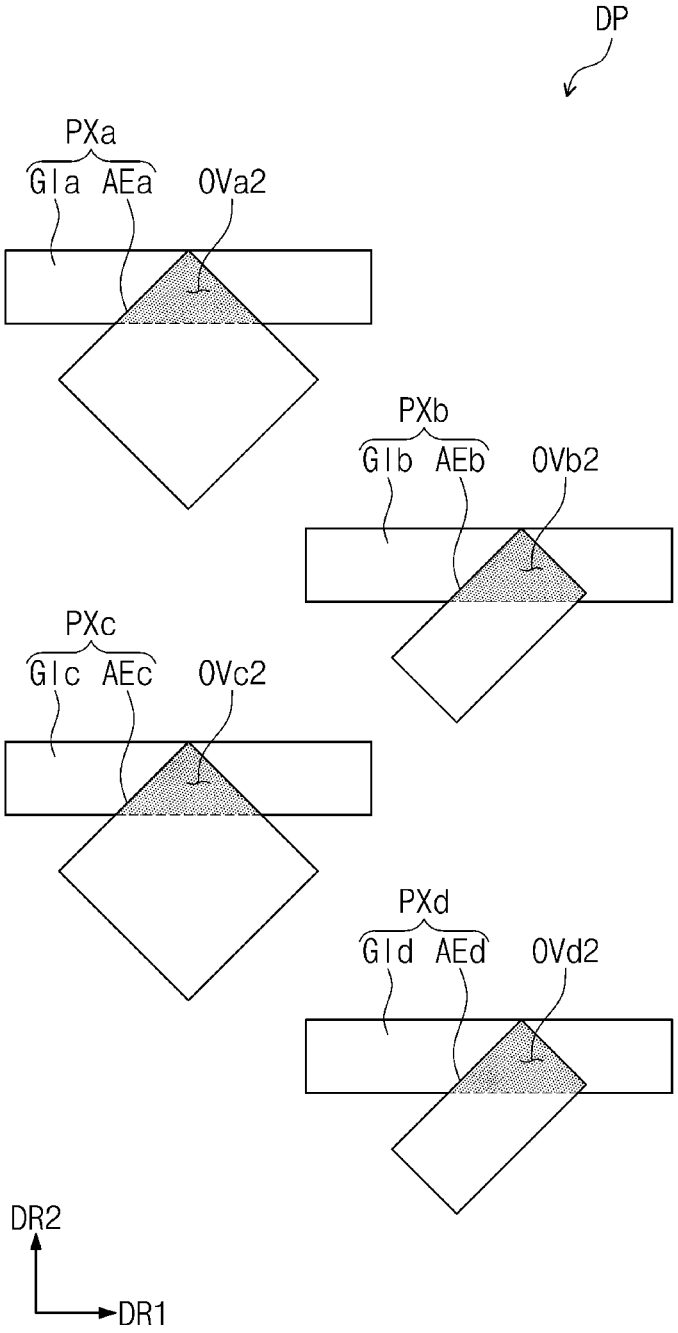

FIG. 8A and FIG. 8B are plan views exemplarily showing the overlapping of the gate electrode G1 of the first transistor T1 and the anode AE of the light emitting diode LD illustrated in FIG. 7.

Referring to FIG. 8A, the display panel DP includes pixels PXa, PXb, PXc, and PXd. A pixel PXa includes a gate electrode G1*a* and an anode AEa. A pixel PXb includes a gate electrode G1*b* and an anode AEb. A pixel PXc includes a gate electrode G1*c* and an anode AEc. A pixel PXd includes a gate electrode G1*d* and an anode AEd.

Although not illustrated in the drawings, the pixel PXa includes the light emitting layer EML (see FIG. 7) of a first color (for example, red), the pixel PXc includes the light emitting layer EML of a second color (for example, blue), and the pixels PXb and PXd may each include the light emitting layer EML of a third color (for example, green). The area of each of the anodes AEb and AEd of the pixels PXb and PXd may be smaller than the area of each of the anodes AEa and AEc of the pixels PXa and PXc. In another embodiment, the anodes AEa, AEb, AEc, and AEd of the pixels PXa, PXb, PXc, and PXd may have the same area.

The anodes AEa, AEb, AEc, and AEd of the pixels PXa, PXb, PXc, and PXd on a plane overlap the gate electrodes G1*a*, G1*b*, G1*c*, and G1*d*, respectively. As described with reference to FIG. 7, the gate electrode G1 and the anode AE of the first transistor T1 overlap to form a capacitance Cga. It is appropriate that the Capacitance Cga is minimized in order to minimize an unwanted change in the signal provided to gate electrode G1 of first transistor T1.

As shown in FIG. 8B, corners of the anodes AEa, AEb, AEc, and AEd of the pixels PXa, PXb, PXc, and PXd may be disposed to overlap the gate electrodes G1*a*, G1*b*, G1*c*, and G1*d*. Therefore, overlapping areas of the anodes AEa, AEb, AEc, and AEd and the gate electrodes G1*a*, G1*b*, G1*c*, and G1*d* may be minimized.

In an example illustrated in FIG. 8A, the overlapping areas of the anodes AEa, AEb, AEc, AEd of the pixels PXa, PXb, PXc, and PXd and the gate electrodes G1*a*, G1*b*, G1*c*, and G1*d* are respectively OVa1, OVb1, OVc1, and OVd1.

In an example illustrated in FIG. 8B, the overlapping areas of the anodes AEa, AEb, AEc, AEd of the pixels PXa, PXb, PXc, and PXd and the gate electrodes G1*a*, G1*b*, G1*c*, and G1*d* are respectively OVa2, OVb2, OVc2, and OVd2.

Also, OVa1>OVa2, OVb1>OVb2, OVc1>OVc2 and OVd1>Ovd2.

As illustrated in FIG. 8B, since the overlapping areas of the anodes AEa, AEb, AEc, and AEd of the pixels PXa, PXb, PXc, and PXd and the gate electrodes G1*a*, G1*b*, G1*c*, and G1*d* are minimized, the capacitance Cga may be minimized.

When the seventh transistor T7 shown in FIG. 5 changes from the turned-on state to the turned-off state, the anodes AEa, AEb, AEc, and AEd of the pixels PXa, PXb, PXc, and PXd are changed to a voltage corresponding to a black gray scale from the initialization voltage VINIT. By the capacitance Cga between the anodes AEa, AEb, AEc, AEd of the pixels PXa, PXb, PXc, and PXd and the gate electrodes G1*a*, G1*b*, G1*c*, and G1*d*, the signal provided to the gate electrode G1 of the first transistor T1 may be changed. As illustrated in FIG. 8B, since the capacitance Cga between the anodes AEa, AEb, AEc, and AEd of the pixels PXa, PXb, PXc, and PXd and the gate electrodes G1*a*, G1*b*, G1*c*, and G1*d* is minimized, the change in the signal provided to the gate electrode G1 of the first transistor T1 may be minimized.

Meanwhile, when the gate electrode G1 and the source electrode S1 of the first transistor T1 overlap on a plane, the capacitance Cgs between the gate electrode G1 and the source electrode S1 of the first transistor T1 may be formed. The capacitance Cgs between the gate electrode G1 and the source electrode S1 of the first transistor T1 may change the signal provided to the gate electrode G1 of the first transistor T1. Therefore, it is preferable to minimize the doping concentration when the P-type dopant is doped on the semiconductor pattern such that the source electrode S1 of the first transistor T1 does not overlap the gate electrode G1.

A display device having the configuration may prevent display quality from being deteriorated even when the off-leakage current of first to seventh transistors in a pixel is increased in a high temperature environment. Also, since the voltage range of a scan signal for controlling the on/off of the first to seventh transistors may be lowered, power consumption may be reduced.

Although certain exemplary embodiments and implementations have been described herein, other embodiments and modifications will be apparent from this description. Accordingly, the inventive concepts are not limited to such embodiments, but rather to the broader scope of the appended claims and various obvious modifications and equivalent arrangements as would be apparent to a person of ordinary skill in the art.

What is claimed is:

1. A display device comprising:

a light emitting diode including a first electrode and a second electrode;

a capacitor connected between a first voltage line for receiving a first power voltage and a reference node;

a first transistor including a source electrode, a drain electrode, and a gate electrode connected to the reference node;

a second transistor connected between a data line and the source electrode of the first transistor and including a gate electrode configured for receiving a scan signal;

a third transistor connected between the reference node and the drain electrode of the first transistor;

a fourth transistor connected between the reference node and a second voltage line configured for receiving an initialization voltage;

a fifth transistor connected between the first voltage line and the source electrode of the first transistor;

a sixth transistor connected between the drain electrode of the first transistor and the first electrode of the light emitting diode; and a seventh transistor connected between the second voltage line and the first electrode of the light emitting diode and including a gate electrode configured for receiving an initialization scan signal, wherein an active period of the scan signal and an active period of the initialization scan signal are configured to be non-overlapping with each other and the active period of the initialization scan signal is configured to be longer than the active period of the scan signal, wherein the first electrode of the light emitting diode has a polygonal shape including a plurality of corners, and one of the plurality of corners of the first electrode and the gate electrode of the first transistor overlap on a plane, and wherein corners other than the one of the plurality of corners of the first electrode and the gate electrode of the first transistor do not overlap on a plane.

2. The display device of claim 1, wherein the sixth transistor comprises a gate electrode configured for receiving a light emitting control signal and the light emitting control signal maintains an inactive state during the active period of the scan signal and the active period of the initialization scan signal.

3. The display device of claim 1, wherein the capacitor comprises an upper electrode connected to the first voltage line, and the upper electrode and the gate electrode of the first transistor overlap on a plane.

4. The display device of claim 1, wherein the third transistor comprises a gate electrode configured for receiving the scan signal.

5. The display device of claim 1, further comprising:

a scan line configured for transmitting the scan signal; and an initialization scan line configured for transmitting the initialization scan signal.

6. The display device of claim 1, further comprising a previous scan line configured for transmitting a previous scan signal, wherein the fourth transistor includes a gate electrode connected to the previous scan line.

7. The display device of claim 6, wherein an active period of the previous scan signal is configured to be non-overlapping with the active period of the scan signal.

8. The display device of claim 7, wherein each of the fifth transistor and the sixth transistor comprises a gate electrode configured for receiving a light emitting control signal, and the light emitting control signal maintains an inactive state during the active period of the previous scan signal, the active period of the scan signal, and the active period of the initialization scan signal.

9. The display device of claim 1, wherein the first to seventh transistors are P-type transistors.

10. The display device of claim 1, wherein an active region of each of the first to seventh transistors comprises polysilicon.

11. The display device of claim 10, wherein the source electrode of the first transistor is extended from the active region of the first transistor.

12. A display device comprising:

a display panel including a pixel and a scan driving circuit configured to output a scan signal for driving the pixel and an initialization scan signal, wherein the pixel includes:

a light emitting diode including a first electrode and a second electrode;

a capacitor connected between a first voltage line configured for receiving a first power voltage and a reference node;

a first transistor including a source electrode, a drain electrode, and a gate electrode connected to the reference node;

a second transistor connected between a data line and the source electrode of the first transistor and including a gate electrode configured for receiving the scan signal;

a third transistor connected between the reference node and the drain electrode of the first transistor;

a fourth transistor connected between the reference node and a second voltage line configured for receiving an initialization voltage;

a fifth transistor connected between the first voltage line and the source electrode of the first transistor;

a sixth transistor connected the drain electrode of the first transistor and the first electrode of the light emitting diode; and a seventh transistor connected between the second voltage line and the first electrode of the light emitting diode and including a gate electrode configured for receiving the initialization scan signal, wherein an active period of the scan signal and an active period of the initialization scan signal are configured to be non-overlapping with each other and the active period of the initialization scan signal is configured to be longer than the active period of the scan signal, wherein the first electrode of the light emitting diode has a polygonal shape including a plurality of corners, and one of the plurality of corners of the first electrode and the gate electrode of the first transistor overlap on a plane, and wherein corners other than the one of the plurality of corners of the first electrode and the gate electrode of the first transistor do not overlap on a plane.

13. The display device of claim 12, wherein the sixth transistor comprises a gate electrode configured for receiving a light emitting control signal and the light emitting control signal maintains an inactive state during the active period of the scan signal and the active period of the initialization scan signal.

14. The display device of claim 12, wherein the first to seventh transistors are P-type transistors.

15. The display device of claim 12, wherein the capacitor comprises an upper electrode connected to the first voltage line, and the upper electrode and the gate electrode of the first transistor overlap on a plane.

16. The display device of claim 3, wherein the upper electrode and a portion of the gate electrode of the first transistor overlap on a plane and are operative to form the capacitor.

17. The display device of claim 15, wherein the upper electrode and a portion of the gate electrode of the first transistor overlap on a plane and are operative to form the capacitor.

* * * * *